US005971785A

United States Patent [19]

Comerci

[11] Patent Number: 5,971,785

[45] Date of Patent: Oct. 26, 1999

[54] HERMAPHRODITIC CONNECTOR FOR PRINTED CIRCUIT BOARDS

[75] Inventor: Joseph D. Comerci, Elmhurst, Ill.

[73] Assignee: Molex Incorporated, Lisle, Ill.

[21] Appl. No.: 08/916,630

[22] Filed: Aug. 22, 1997

[51] Int. Cl.[6] ..... H01R 13/28

[52] U.S. Cl. ..... 439/287; 439/65; 439/284

[58] Field of Search ..... 439/65, 79, 284, 439/287–290, 291, 295, 660

[56] References Cited

U.S. PATENT DOCUMENTS

| | | | |
|---|---|---|---|
| 4,632,475 | 12/1986 | Tomita . | |
| 4,657,320 | 4/1987 | Bamford et al. . | |
| 4,701,133 | 10/1987 | Worth | 439/13 |
| 4,863,388 | 9/1989 | Reimer et al. | 439/31 |
| 4,877,409 | 10/1989 | Tanigawa et al. | 439/31 |
| 4,975,062 | 12/1990 | Evans et al. | 439/13 |
| 5,575,674 | 11/1996 | Davis et al. | 439/284 |
| 5,727,961 | 3/1998 | Landis . | |

*Primary Examiner*—Khiem Nguyen
*Attorney, Agent, or Firm*—Stephen Z. Weiss

[57] ABSTRACT

An electrical connector assembly is provided for electrically connecting a pair of generally coplanar printed circuit boards. The assembly includes a pair of hermaphroditic connectors adapted for mating in either opposite direction generally perpendicular to the plane of the circuit boards. Each connector includes a housing having a plurality of spaced-apart ribs defining respective spaces between immediately adjacent ribs. The ribs of each connector are interleaved with the ribs of the other connector when the two connectors are mated. A plurality of terminals are mounted on each housing and have rounded hermaphroditic contact portions on the same sides of the ribs so that the contact portions on one connector facingly engage the contact portions on the other connector when the connectors are mated in either opposite direction generally perpendicular to the plane of the circuit boards.

8 Claims, 7 Drawing Sheets

24
46
38
34
42b
A
36
44b
36
38
36
22
24
36
34
22

HERMAPHRODITIC CONNECTOR FOR PRINTED CIRCUIT BOARDS

FIELD OF THE INVENTION

This invention generally relates to the art of electrical connectors and, particularly, to an electrical connector assembly comprising a pair of hermaphroditic electrical connectors for electrically connecting a pair of printed circuit boards.

BACKGROUND OF THE INVENTION

Complex electronic equipment which uses semiconductor technology relies heavily on electrical interconnection systems for interconnecting a pair of printed circuit boards. A printed circuit board typically includes a relatively rigid substrate having a circuit pattern printed thereon and mounting a plurality of circuit devices. This subassembly, in turn, is mounted within a larger apparatus and electrically connects a wide variety of other components or modules.

Electrical connectors are used to relatively mount and interconnect a pair of circuit boards in a variety of configurations or orientations. For instance, an electrical connector may be mounted on a main printed circuit board, often called a "mother" board, and the connector receives a "daughter" board in an edge-wise configuration. In some configurations, a pair of circuit boards are interconnected in a generally coplanar relationship. In fact, some electrical connector assemblies allow for the pivoting of one board relative to the other board at adjacent edges of the boards. With circuit boards that are interconnected in an edge-wise, coplanar arrangement, it would be desirable to allow for interconnection of the boards in a direction generally perpendicular to the boards. Otherwise, if the boards are interconnected in the plane of their eventual coplanar configuration, considerable space is required in the larger apparatus for moving the boards together in a single planar area.

In addition, electrical connectors for interconnecting a pair of circuit boards often are complex and expensive, involving one type of connector (such as a male or plug connector) mounted to one of the circuit boards, and still another type of connector (such as a receptacle connector) mounted on the other circuit board. It would be desirable to provide a simple hermaphroditic electrical connector that can be mounted on both circuit boards and still provide for interconnecting movement generally perpendicular to the eventual coplanar boards. The present invention is directed to satisfying these needs and solving the various problems involved in the design of simple and inexpensive electrical connectors for interconnecting printed circuit boards.

SUMMARY OF THE INVENTION

An object, therefore, of the invention is to provide a new and improved electrical connector assembly for electrically connecting a pair of generally coplanar printed circuit boards.

Another object of the invention is to provide such an assembly which includes a pair of hermaphroditic connectors adapted for mating in either opposite direction generally perpendicular to the plane of the circuit boards.

In the exemplary embodiment of the invention, each hermaphroditic connector includes a housing having a plurality of spaced-apart ribs defining respective spaces between immediately adjacent ribs. The ribs of each hermaphroditic connector are interleaved with the ribs of the other connector when the two connectors are mated. A plurality of terminals are mounted on each housing of each connector, and the terminals have flexible hermaphroditic contact portions on the same sides of the ribs so that the contact portions on one connector facingly engage the contact portions on the other connector when the connectors are mated. The contact portions are rounded to facilitate mating of the connectors in either opposite direction generally perpendicular to the plane of the coplanar printed circuit boards.

As disclosed herein, the terminals are stamped and formed of sheet metal material, and the contact portions are bowed with an axis of the curve of the bow extending in a direction generally parallel to the plane of the coplanar printed circuit boards. In the preferred embodiment, the terminals are arranged on each housing to provide two spaced-apart rows of contact portions each row generally parallel to the plane of the printed circuit boards. The terminals, including the contact portions thereof, in each row are substantially identical in both of the pair of hermaphroditic connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
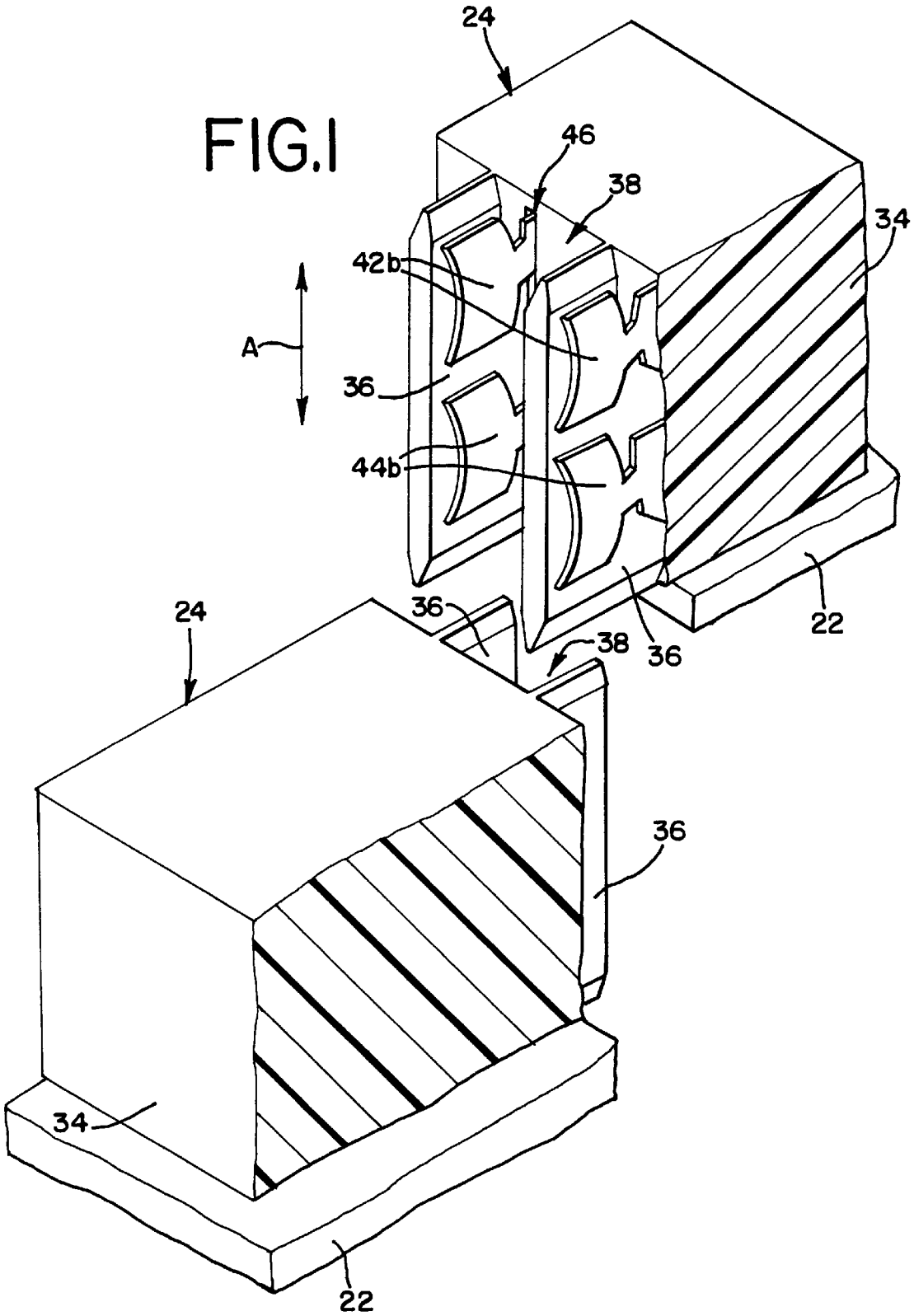
FIG. 1 is a fragmented perspective view of adjacent ends of a pair of hermaphroditic connectors embodying the concepts of the invention as mounted on printed circuit boards.
Figure 2:
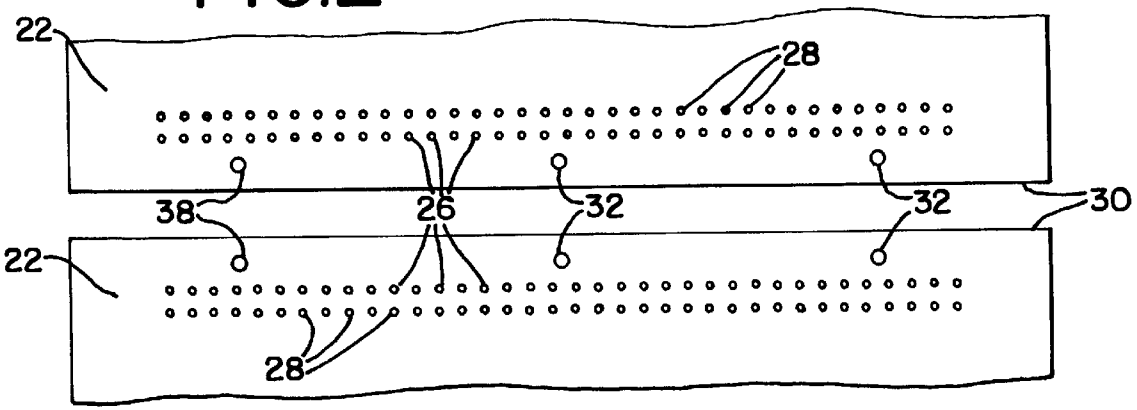
FIG. 2 is a fragmented plan view of the edges of a pair of coplanar printed circuit boards to be connected by the hermaphroditic connectors of FIG. 1.

Referring to the drawings in greater detail, and first to FIGS. 1 and 2, the invention is embodied in an electrical connector assembly, generally designated 20, for electrically connecting a pair of generally coplanar printed circuit boards 22. The connector assembly includes a pair of hermaphroditic connectors, generally designated 24, adapted for mating in either opposite direction generally perpendicular to the plane of the coplanar circuit boards, as indicated by double-headed arrow "A" in FIG. 1. As seen in FIG. 2, each board has a substantially identical array of two rows of holes 26 and 28. Holes 26 are in rows closer to edges 30 of the boards than holes 28 which are in rows further away from the edges. A plurality of mounting holes 32 also are provided in the boards. Appropriate circuit traces (not shown) also are provided on the boards and/or in the holes.

Figure 3:
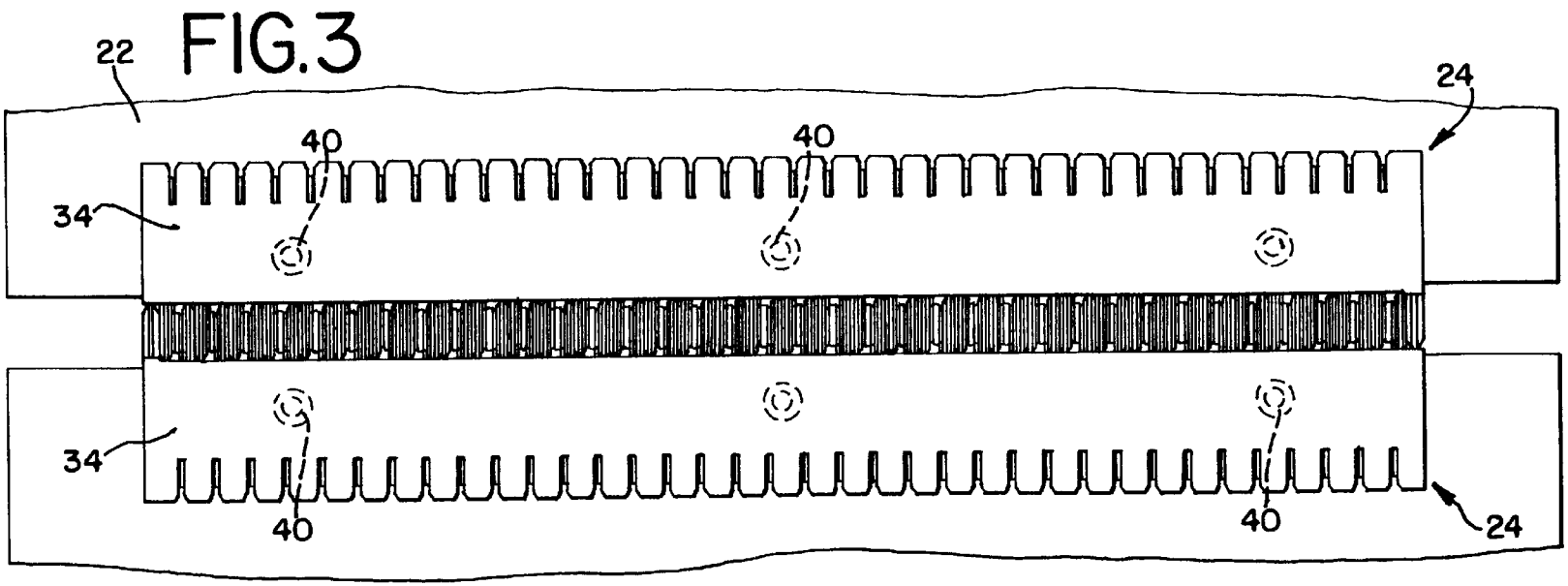
FIG. 3 is a plan view of the circuit boards interconnected by the connectors.
Figure 4:
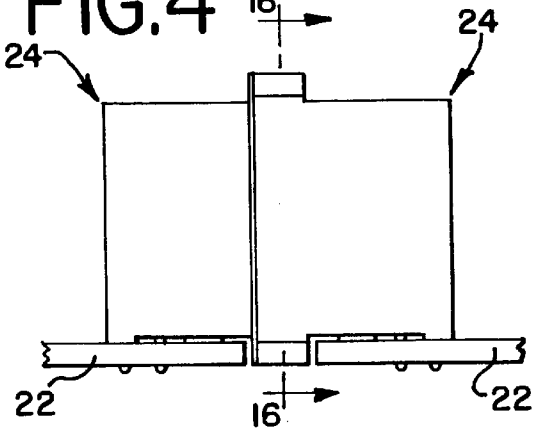
FIG. 4 is an end elevational view of the interconnected boards and connectors of FIG. 3.

FIGS. 3 and 4 show the two printed circuit boards 22 interconnected by a pair of the hermaphroditic connectors according to the invention. This interconnection will be described in greater detail hereinafter.

Figure 6:
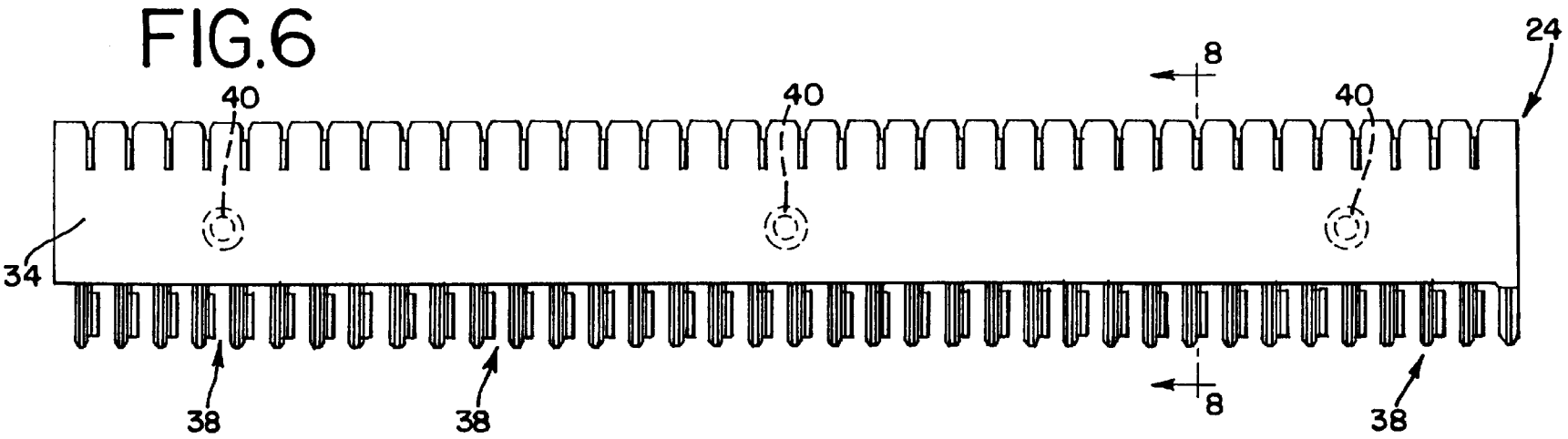
FIG. 6 is a top plan view of one of the connectors.
Figure 5:
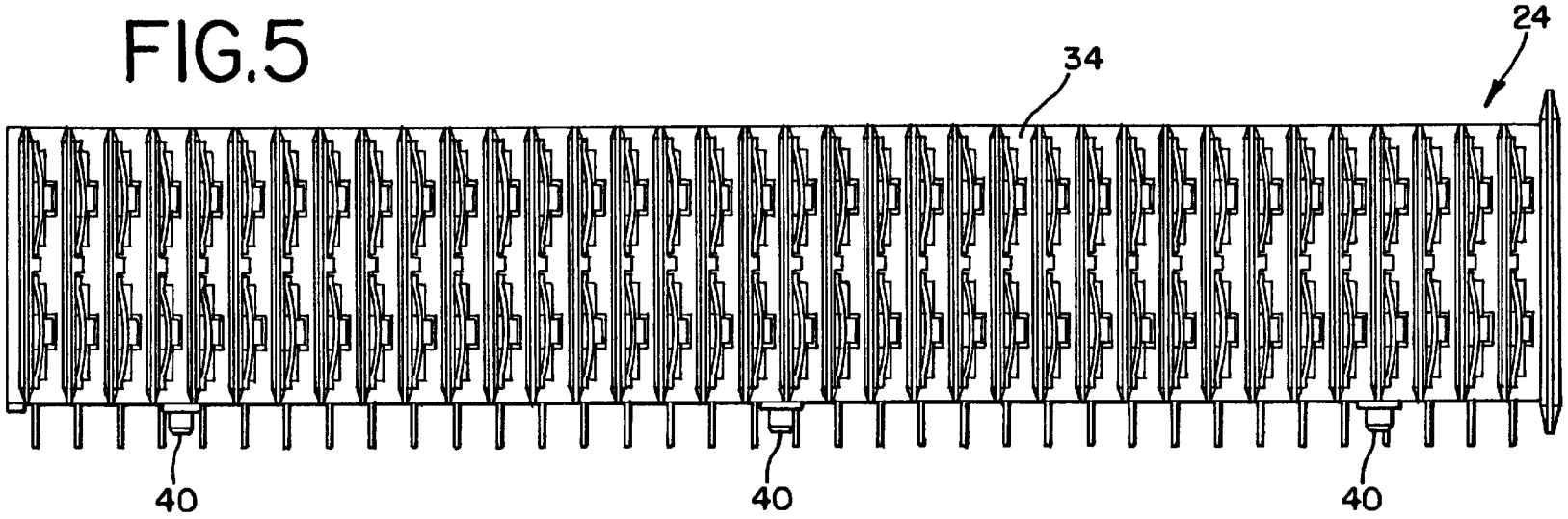
FIG. 5 is a front elevational view of the mating face of one of the connectors.
Figure 7:
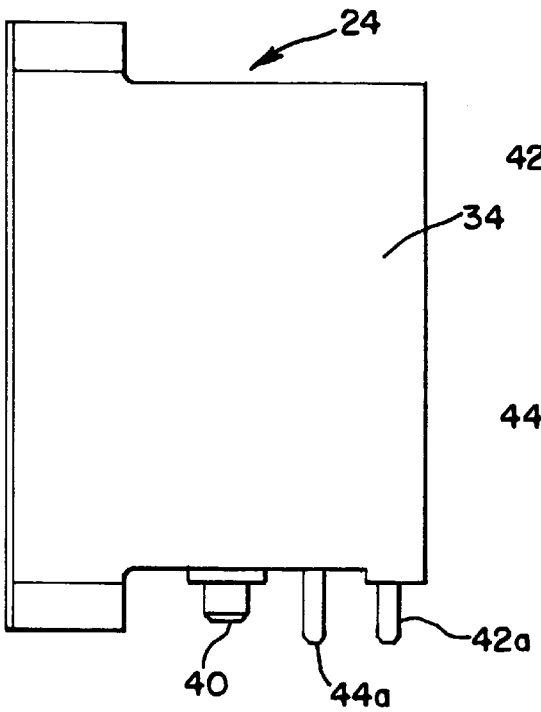
FIG. 7 is an end elevational view of one of the connectors.
Figure 8:
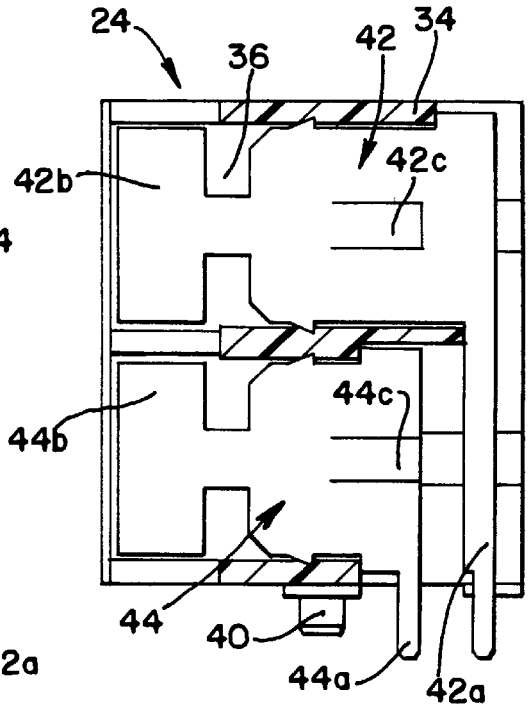
FIG. 8 is a vertical section taken generally along line 8—8 of FIG. 6.

Referring to FIGS. 5–7 in conjunction with FIG. 1, each hermaphroditic electrical connector is substantially identical and includes a housing 34 having a plurality of spaced-apart ribs 36 defining respective spaces, generally designated 38, between immediately adjacent ribs. The ribs of each hermaphroditic connector are interleaved with the ribs of the other connector when the two connectors are mated as seen in FIG. 3. FIG. 5 shows that housing 34 has a plurality of mounting pegs 40 for insertion into mounting holes 32 (FIG. 2) of the printed circuit boards.

Referring to FIGS. 8–12 in conjunction with FIG. 1, a plurality of terminals are mounted on each housing 34 of each hermaphroditic connector 24. Generally, the terminals have flexible hermaphroditic contact portions on the same sides of ribs 36 so that the contact portions on one connector facingly engage the contact portions on the other connector when the connectors are mated.

Figure 10:
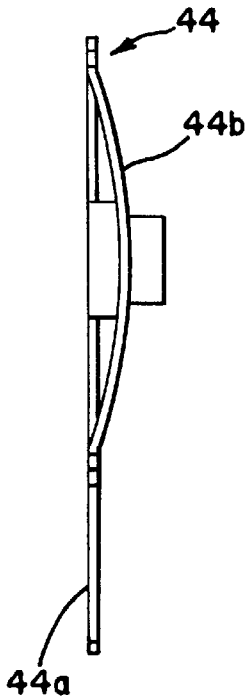
FIG. 10 is an edge view of the lower terminal of FIG. 9.
Figure 9:
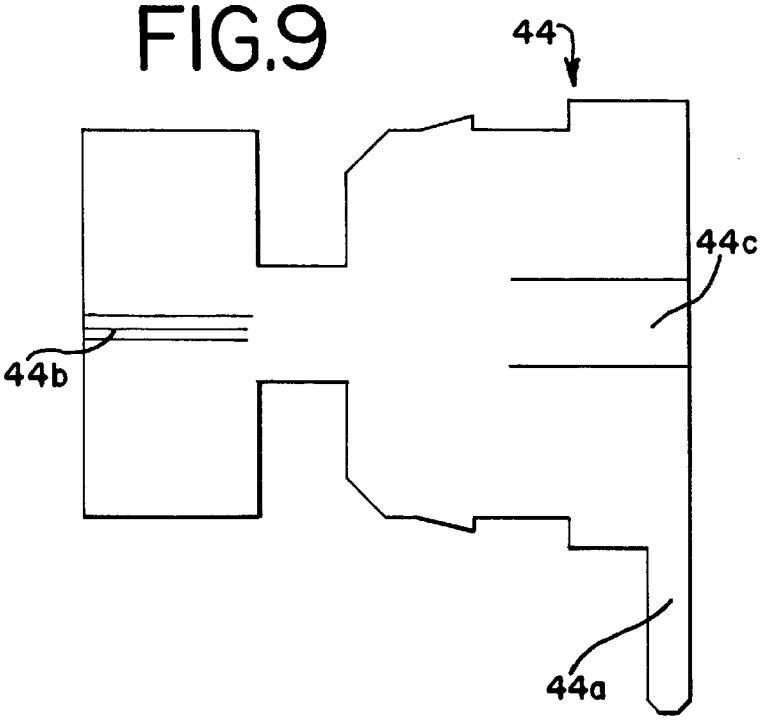
FIG. 9 is a side elevational view of one of the lower terminals.
Figure 12:
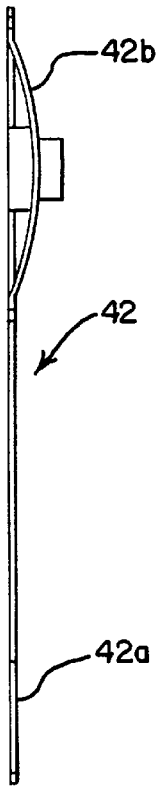
FIG. 12 is an edge view of the upper terminal.
Figure 11:
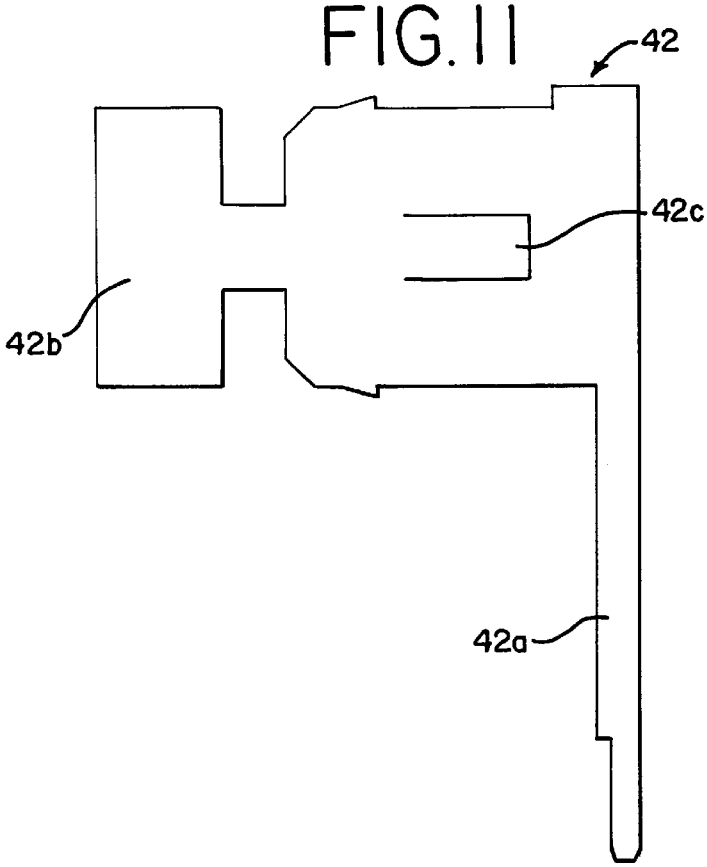
FIG. 11 is a side elevational view of one of the upper terminals.

More particularly, each hermaphroditic connector 24 mounts two rows of terminals which include a row of upper terminals, generally designated 42 and shown in detail in FIGS. 11 and 12, and a row of lower terminals, generally designated 44 and shown in detail in FIGS. 9 and 10. All of the terminals are very similarly configured, particularly their flexible contact portions (described below) but upper terminals 42 have longer tail portions 42*a* for insertion into the rows of holes 28 (FIG. 2) in the printed circuit boards, and lower terminals 44 have shorter tail portions 44*a* for insertion into the rows of holes 26 in the printed circuit boards.

Still referring to FIGS. 8–12 in conjunction with FIG. 1, upper terminals 42 have hermaphroditic contact portions 42*b*, and lower terminals 44 have hermaphroditic contact portions 44*b*. All of the terminals are stamped and formed of sheet metal material, and flexible contact portions 42*b* and 44*b* are rounded or bowed outwardly from the respective ribs 36 against which the terminals are mounted, as clearly seen in FIG. 1. FIGS. 10 and 12 show the bowed configurations of the contact portions in isolation (i.e. removed from the housing and ribs 36). In other words, contact portions 42*b* and 44*b* are bowed with an axis of the curve of the bow extending in a direction generally parallel to the plane of the coplanar printed circuit boards 22 which are to be interconnected. Finally, upper terminals 42 have latch tabs 42*c* and lower terminals 44 have latch tabs 44*c* for securing the terminals within narrow slots 46 (FIG. 1) formed in housing 34.

Figure 13:
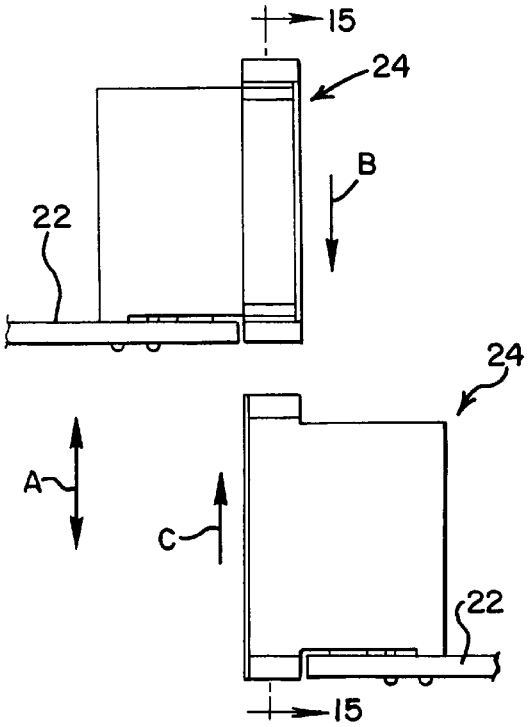
FIG. 13 is an end view of a pair of connectors and respective circuit boards about to mated in one direction generally perpendicular to the boards.
Figure 14:
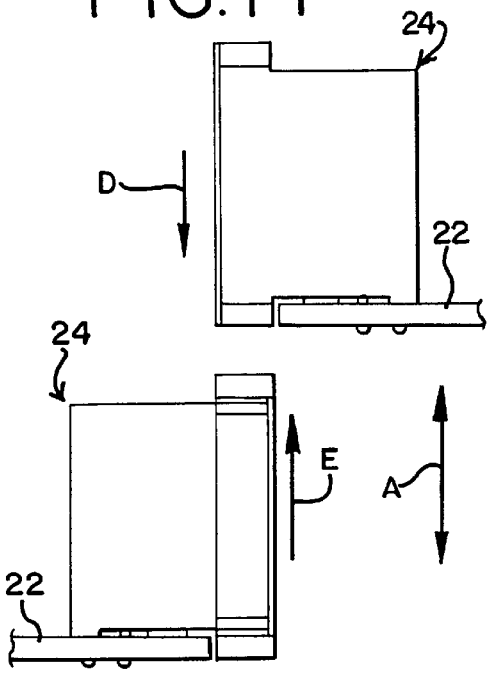
FIG. 14 is a view similar to that of FIG. 13, with the connectors and boards about to be interconnected in an opposite direction.

FIGS. 13 and 14 show a pair of the hermaphroditic electrical connectors of the invention mounted to a pair of the printed circuit boards 22 to depict how the connectors are mated in either opposite direction generally perpendicular to the plane of the coplanar circuit boards as indicated by double-headed arrow "A". More particularly, the top/left connector in FIG. 13 can be moved downwardly in the direction of arrow "B" for mating with the bottom/right connector. Conversely, the bottom/right connector can be moved upwardly in the direction of arrow "C" to mate the connectors and interconnect the circuit boards in a coplanar configuration as seen in FIG. 4. Of course, both connectors can be moved simultaneously in the direction of arrows "B" and "C" for mating purposes to interconnect the circuit boards.

Similarly, FIG. 14 shows that the top/right connector can be moved downwardly in the direction arrow "D", or the bottom/left connector can be moved upwardly in the direction of arrow "E", or simultaneously, to mate the connectors and interconnect the circuit boards. This versatility of the connectors is afforded by an extremely simple and inexpensive connector construction involving a simple one-piece molded plastic housing and a plurality of similarly configured stamped and formed terminals having hermaphroditic contact portions.

Figure 15:
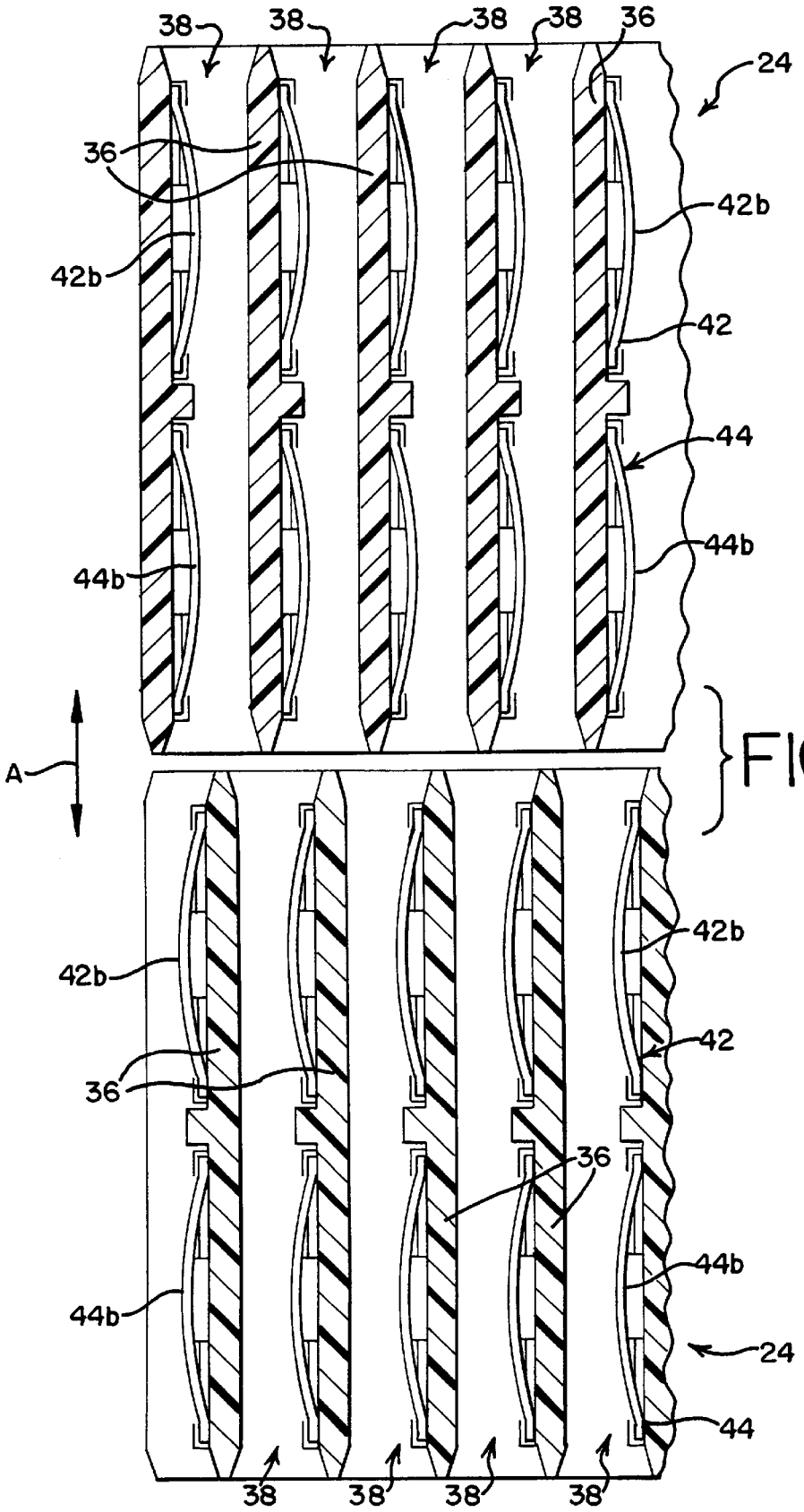
FIG. 15 is a vertical section taken generally along line 15—15 of FIG. 13.
Figure 16:
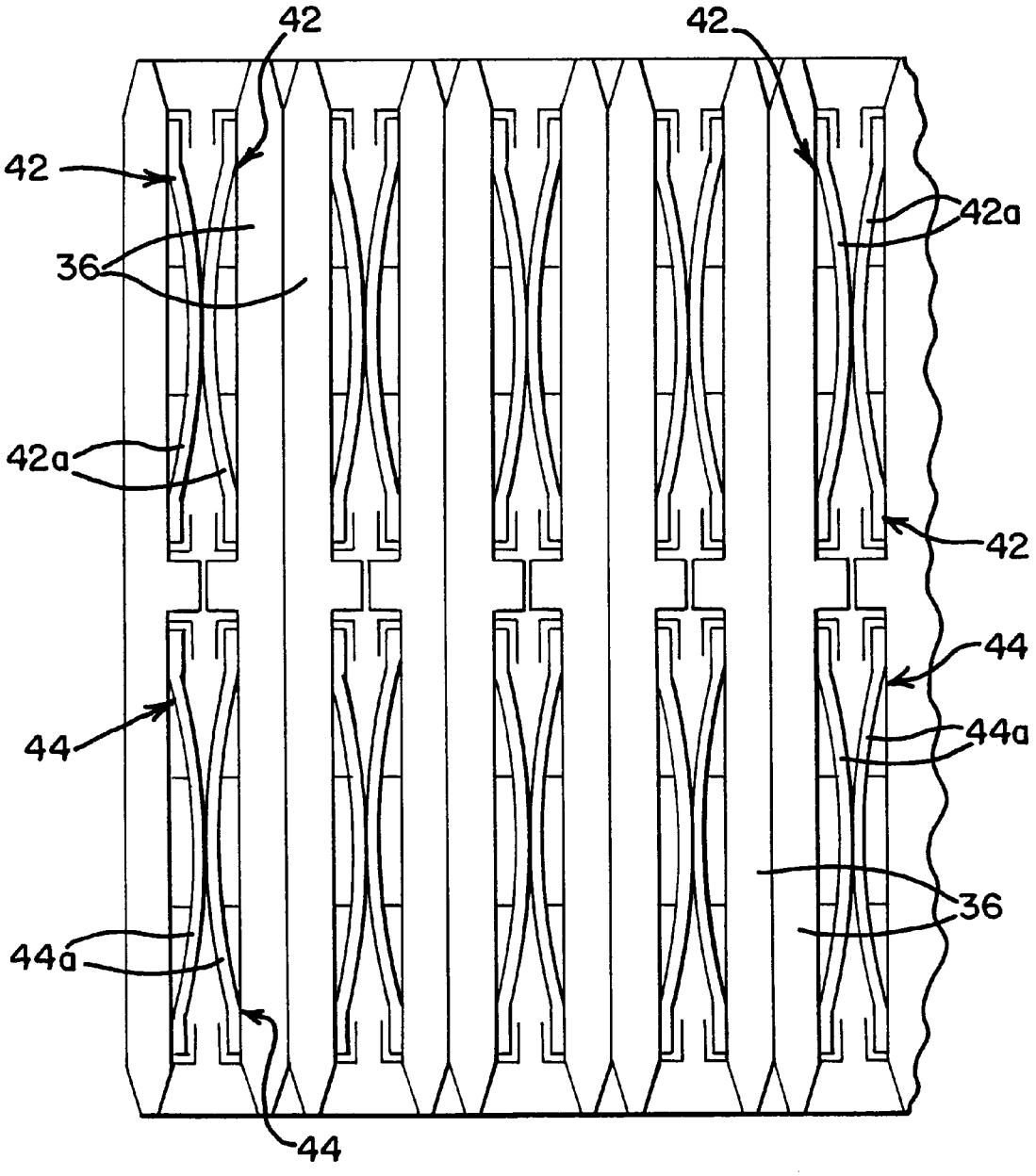
FIG. 16 is a vertical section taken generally along line 16—16 of FIG. 4.

FIGS. 15 and 16 best show the hermaphroditic nature of contact portions 42*b* of upper terminals 42 and contact portions 44*b* of lower terminals 44. In essence, all of the contact portions of all of the terminals are substantially identically formed in their bowed configurations. FIG. 15 also shows quite clearly how the spaced-apart ribs 36 of the connectors define respective spaces 38 between immediately adjacent ribs so that the ribs and terminals of one hermaphroditic connector can move into the spaces between the ribs and terminals of the other hermaphroditic connector.

In assembly, connectors 24 are moved in the direction of double-headed arrow "A" in FIG. 15 until the connectors are mated as shown in FIG. 16, the mating direction being generally perpendicular to the eventually interconnected coplanar circuit boards. FIG. 16 clearly shows how the hermaphroditic contact portions 42*b* and 44*b* of the terminals, being mounted on the same sides of their respective ribs, are hermaphroditically arranged so that the contact portions on one connector facingly engage the contact portions on the other connector when the connectors are mated. The rounded or bowed configuration of the contact portions allow the connectors to be mated with low mating forces.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly for electrically connecting a pair of generally coplanar printed circuit boards, including a pair of hermaphroditic connectors adapted for mating in either opposite direction generally perpendicular to the plane of the circuit boards, each hermaphroditic connector comprising:

a housing having a plurality of spaced-apart ribs defining respective spaces between immediately adjacent ribs, the ribs of each hermaphroditic connector being interleaved with the ribs of the other connector when the two connectors are mated; and a plurality of terminals mounted on each housing and having hermaphroditic flexible contact portions on the same sides of said ribs so that the contact portions on one connector facingly engage the contact portions on the other connector when the connectors are mated, the flexible contact portions being rounded to facilitate said mating of the connectors in either opposite direction generally perpendicular to the plane of the printed circuit boards.

2. The electrical connector assembly of claim 1 wherein said terminals are stamped and formed of sheet metal material, and said flexible contact portions being bowed with an axis of the curve of the bow extending in a direction generally parallel to the plane of the printed circuit boards.

3. The electrical connector assembly of claim 1 wherein said terminals are arranged on each housing to provide two spaced-apart rows of contact portions each row generally parallel to the plane of the printed circuit boards.

4. The electrical connector assembly of claim 3 wherein the terminals, including the contact portions thereof, in each row are substantially identical.

5. An electrical connector assembly for electrically connecting a pair of generally coplanar printed circuit boards, including a pair of hermaphroditic connectors adapted for mating in either opposite direction generally perpendicular to the plane of the circuit boards, each hermaphroditic connector comprising:

a housing having a plurality of spaced-apart ribs defining respective spaces between immediately adjacent ribs, the ribs of each hermaphroditic connector being interleaved with the ribs of the other connector when the two connectors are mated; and a plurality of stamped and formed sheet metal terminals mounted on each housing and having flexible hermaphroditic contact portions on the same sides of said ribs so that the flexible contact portions on one connector facingly engage the flexible contact portions on the other connector when the connectors are mated, the terminals being arranged on each housing to provide two spaced-apart rows of contact portions each row generally parallel to the plane of the printed circuit boards, the flexible contact portions being bowed with an axis of the curve of the bow extending in a direction generally parallel to the plane of the coplanar printed circuit boards to facilitate said mating of the connectors in either opposite direction generally perpendicular to the boards, the terminals, including the flexible contact portions thereof, in each row being substantially identical.

6. An electrical connector assembly for electrically connecting a pair of generally coplanar printed circuit boards, including a pair of hermaphroditic connectors adapted for mating in either opposite direction generally perpendicular to the plane of the circuit boards, each hermaphroditic connector comprising:

a housing having a plurality of spaced-apart ribs defining respective spaces between immediately adjacent ribs, the ribs of each hermaphroditic connector being interleaved with the ribs of the other connector when the two connectors are mated; and a plurality of terminals mounted on each housing and having hermaphroditic contact portions on the same sides of said ribs so that the contact portions on one connector facingly engage the contact portions on the other connector when the connectors are mated, the contact portions comprising male-type blades to facilitate said mating of the connectors in either opposite direction generally perpendicular to the plane of the printed circuit boards, the blades on at least one of the connectors being rounded.

7. The electrical connector assembly of claim 6 wherein said terminals are stamped and formed of sheet metal material, and said rounded blades are flexible and are bowed with an axis or the curve of the bow extending in a direction generally parallel to the plane of the printed circuit boards.

8. The electrical connector assembly of claim 6 wherein said terminals are arranged on each housing to provide two spaced-apart rows of contact portions generally parallel to the plane of the printed circuit boards.

* * * * *